US005226645A

United States Patent [19]

Stewart

[11] Patent Number: 5,226,645

[45] Date of Patent: Jul. 13, 1993

[54] BASEBALL POWER SWING TRAINER

[76] Inventor: Roger K. Stewart, 39760 Bradbury Rd., Middleport, Ohio 45760

[21] Appl. No.: 849,705

[22] Filed: Mar. 11, 1992

[51] Int. Cl.[5] ..... A63B 69/40

[52] U.S. Cl. ..... 273/26 R

[58] Field of Search ..... 273/26 R, 29 A, 29 R, 273/26 E, 186 C, 186 R, 191 A; 124/78; 272/102

[56] References Cited

U.S. PATENT DOCUMENTS

| | | | |
|---|---|---|---|
| 3,386,733 | 6/1968 | Russo | 273/26 R |
| 3,475,026 | 10/1969 | Cooper | 273/26 R |
| 3,805,062 | 4/1974 | Holmes | 272/102 |
| 4,021,036 | 5/1977 | Nelson | 273/26 R |
| 4,097,044 | 6/1978 | Miniere | 273/26 R |
| 4,423,717 | 1/1984 | Kahelin | 273/26 D |
| 4,451,036 | 5/1984 | Sinclair | 273/26 R |
| 4,783,070 | 11/1988 | Bauer | 273/29 A |

*Primary Examiner*—Theatrice Brown
*Attorney, Agent, or Firm*—Biebel & French

[57] ABSTRACT

A baseball training device is provided for use with the device having a base, a post extending upwardly from the base, an upper sleeve member secured to the post with the upper sleeve member having an upper barrier spaced a distance from the post, and a lower sleeve member secured to the post with a lower barrier spaced a distance from the post. A method of utilizing this baseball training device is also disclosed.

8 Claims, 4 Drawing Sheets

64
19
74
60
62
75
72
90
76
77
88
86
80
65
90
104
84
148
100
102
146
114
21
150
82
118
105
140
142
130
170
116
125
17
132
32C
44
43
41
32A
32D
15
45
38
47
31
32B
34
38
35
36
38
38
40
36
34

BASEBALL POWER SWING TRAINER

BACKGROUND OF THE INVENTION

The present invention relates generally to a baseball training apparatus, and more particularly, to such a device which can be used to improve the power and hitting ability of a batter.

A desirable characteristic of baseball players is that they possess acceptable hitting skills. Two of the most important contributors to good hitting are power and the ability to swing so as to have the bat meet the ball. Until now, the only generally accepted way of developing power has been through practice coupled with weight training to develop the muscles of the upper body. Similarly, attempts at increasing one's ability to hit a ball have generally focused on practice coupled with the use of devices such as the ball holder disclosed in U.S. Pat. No. 2,772,882. While practice, weight training, and the use of existing training devices have proved somewhat helpful, there is a perceived need for a baseball training device which can simultaneously increase the power of a swing, while at the same time developing a swing which will result in the batter more effectively gaining contact with the ball.

The type of swing which is most desirable is a level swing. From that initial type of swing, a batter may proceed to strike the lower side of a ball to induce a fly ball or strike the top side of the ball to induce a grounder. In either event, it is important for the batter to have the bat make good contact with the ball. Some players, try as they might, have extreme difficulty with producing a level swing. Instead, the player is said to be reaching upwardly or downwardly with the bat. In fact, in some cases a player may actually prefer to hit in this nonlevel manner under the belief that such a hitting style is more powerful or effective.

Until now, no baseball training device has existed which can be used with all the aforementioned types of swings to develop power, as well as improve hitting ability. It is thus apparent that the need exists for a baseball training device or the like which improves the accuracy of a batter's swing in addition to building a more powerful swing.

SUMMARY OF THE INVENTION

The problems associated the prior baseball training devices are overcome in accordance with the present invention by fabricating a baseball training device which comprises a base, a post extending upwardly from the base, and upper and lower sleeve members secured to the post. The upper sleeve member comprises an upper barrier which is spaced a distance from the post. Similarly, the lower sleeve member comprises a lower barrier which is spaced a distance from the post. Additionally, the upper sleeve member has a horizontal component disposed, at least in part, between the post and the upper barrier. The lower sleeve member also has a horizontal component disposed, at least in part, between the post and the lower barrier.

In the preferred embodiment of the invention the base is formed of a base plate, a post support which is secured to the base plate, and a plurality of rib supports secured to both the base plate and the post support. The post support in turn is secured to the post. Additionally, preferably the base has secured thereto a plurality of positionable castors.

Both the upper sleeve member and the lower sleeve member preferably are formed such that a threaded bolt can be passed through one of the plurality of post apertures formed in the post. Additionally, the upper barrier and the lower barrier both have vertical axes, which may be coincident or which may be parallel to each other depending upon the positioning of the upper barrier relative to the lower barrier. Preferably the lower barrier rotates relative to the horizontal component.

There is also disclosed a baseball training device having a base, with the base formed of a base plate, a post support secured to the base plate, and a plurality of rib supports secured to both the base plate and the post support, a post extending upwardly from the base, and both an upper and lower sleeve member secured to the post. The upper sleeve member has an upper barrier spaced a distance from the post, as well as an upper sleeve member horizontal component, with the upper sleeve member horizontal component disposed, at least in part, between the post and the upper barrier. Similarly, the lower sleeve member has a lower barrier spaced a distance from the post and a lower sleeve member horizontal component disposed, at least in part, between the post and the lower barrier. In this device, the lower barrier preferably rotates relative to the lower sleeve member horizontal component.

Additionally, the upper barrier and lower barrier both have vertical axes which may either be coincident or parallel to each other, depending upon the relative positioning of the upper barrier with respect to the lower barrier. Finally, both the upper sleeve member and lower sleeve member have formed therein a bolt oriented so as to pass through one of a plurality of apertures formed in the post.

There is also disclosed a method of baseball training which includes the steps of positioning a batter a predetermined distance from a baseball training device with the baseball training device having a base, a post extending upwardly from the base, ad an upper and lower sleeve member secured to the post. The upper sleeve member has an upper barrier spaced a distance from the post while the lower sleeve member has a lower barrier spaced a distance from the post. The upper barrier is spaced a first distance from the lower barrier. The first distance is preferably greater than the width of the bat. The method includes the step of having a batter swing a bat towards the device such that the path of the bat is directed at the space between the upper barrier and the lower barrier.

The method includes the additional step of subsequently adjusting the distance between the upper barrier and lower barrier so that it is less than the first distance. Additionally, the method includes the step of adjusting the position of the upper barrier relative to the post so as to require the path of the bat to change when compared to the path of the bat prior to the adjustment.

It is the primary object of the present invention to provide a baseball training device which is convenient and relatively inexpensive, and yet which can provide a device for developing an accurate, as well as powerful, swing.

Another object is to provide a device which may be used both indoors and outdoors. An important aspect of this object is to provide a device can be easily transported to the training site and which can be quickly disassembled.

A still further object of the present invention is to provide a baseball training apparatus which can be used with a variety of types of swings to develop a more powerful swing.

Other objects and advantages of the invention will be apparent from the following description, the accompanying drawings, and the appended claims.

DETAILED DESCRIPTION OF THE INVENTION

Figure 1:
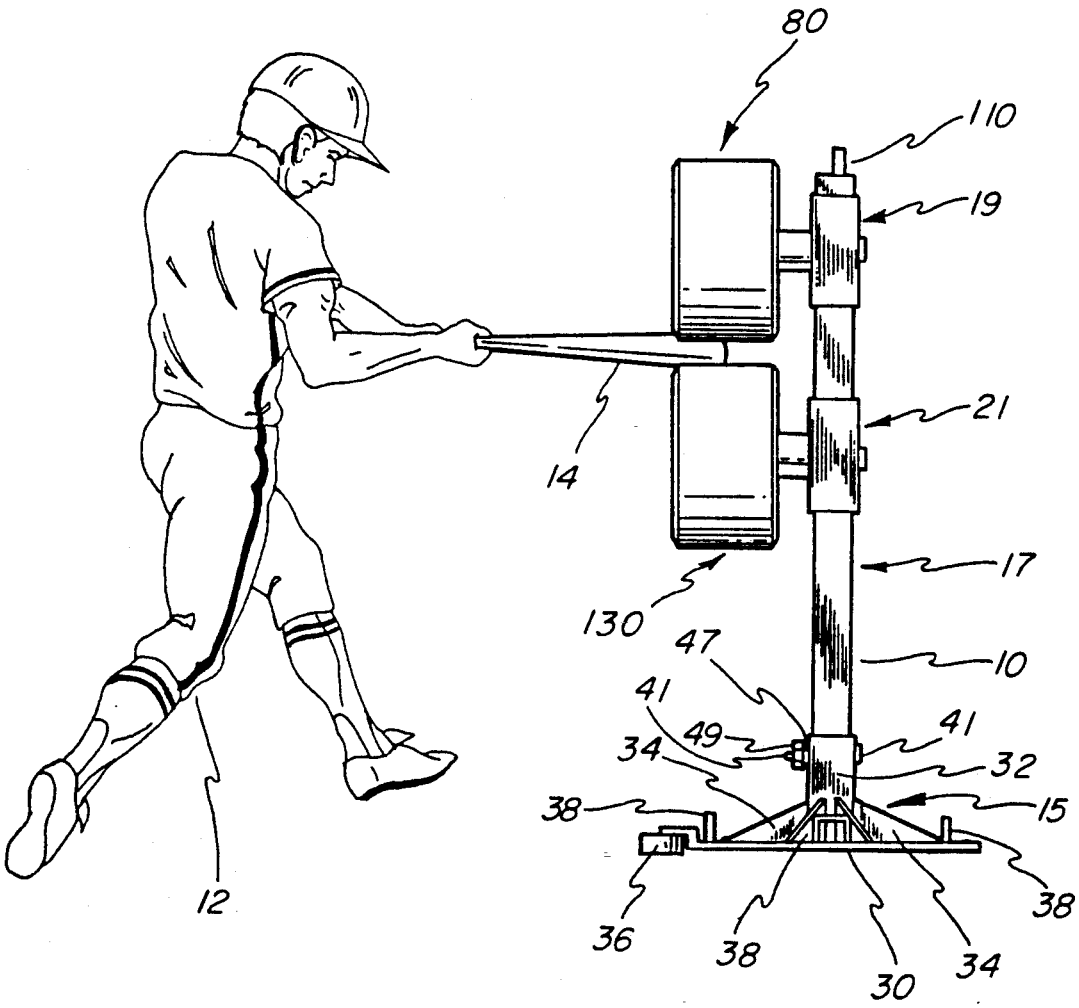
FIG. 1 is a perspective view showing the device of the invention being used for training in accordance with the method of the invention.

Having reference to the drawings, attention is directed first to FIG. 1 which is a perspective view of a baseball training device made in accordance with the present invention and designated generally by the numeral 10. FIG. 1 also demonstrates a player 12 using a bat 14 so as to utilize the method associated with the present invention as well.

Figure 2:
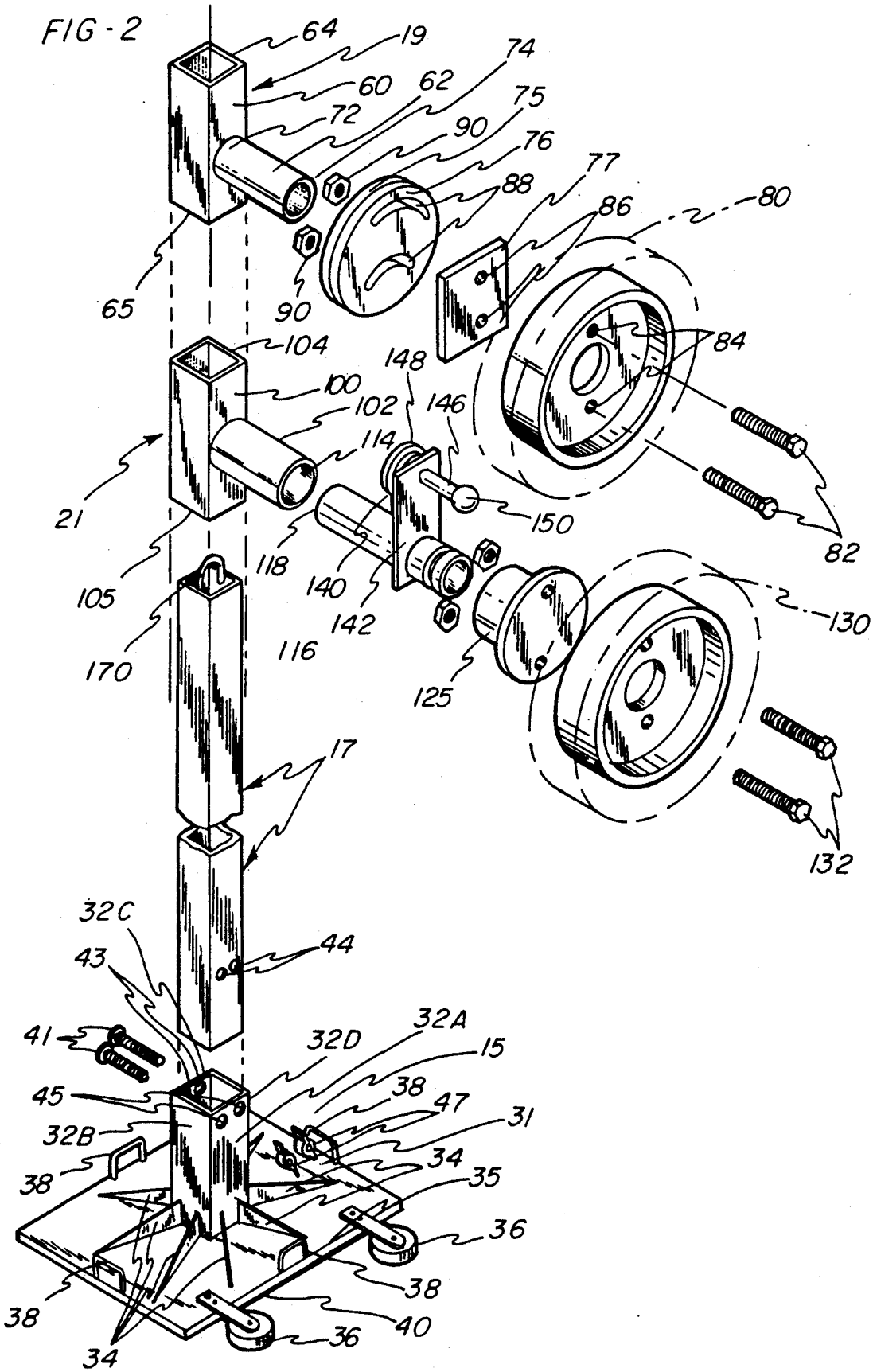
FIG. 2 is an exploded view showing the various components used to form the device of this invention.
Figure 3:
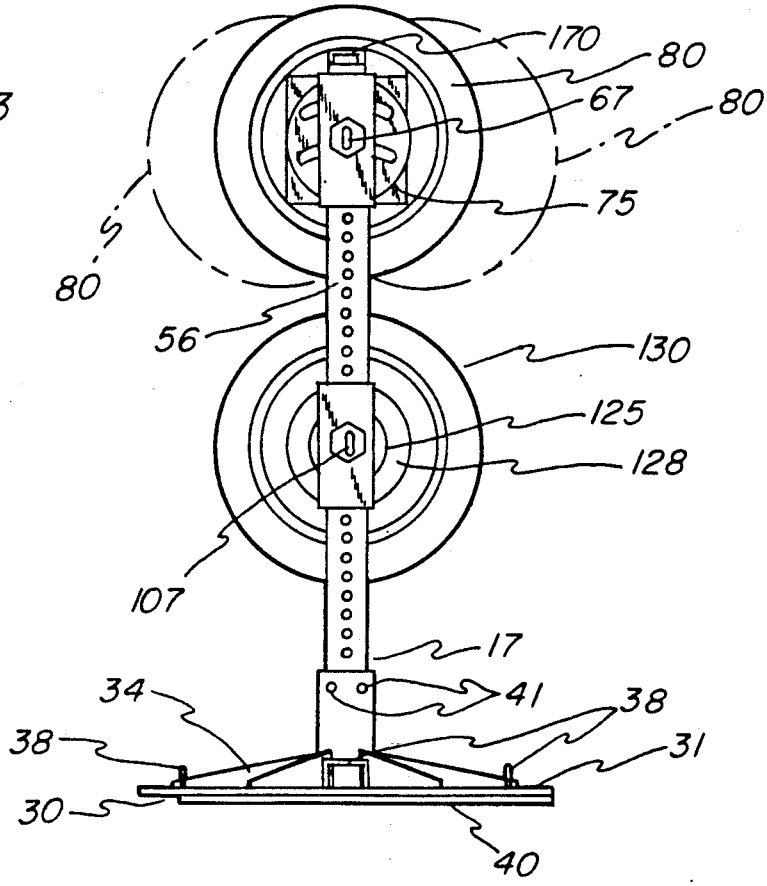
FIG. 3 is a rear elevational view from the back of the device shown in FIG. 2 after being assembled.

The baseball training device 10 is formed generally having a base 15, a center post 17, an upper sleeve member 19 and a lower sleeve member 21. The base 15 as can be seen in comparing FIGS. 1, 2 and 3, is formed having a base plate 30 with the base plate 30 having a base plate upper surface 31. The base 15 also has a post support 32 having sides 32*a*, 32*b*, 32*c*, and 32*d* secured to the upper surface 31 and extending upwardly therefrom. Additionally, a plurality of rib supports 34 are secured along adjacent edges to the base plate 30 and post support 32.

The base plate 30 also has opposing plate edges 35 with two castors 36 secured adjacent one edge. Preferably the castors are two hard rubber wheels, 6" in diameter and with a tread width of 2". Also secured along opposite plate edges 35 and opposite ends are a total of four handles 38 which are formed in a vertical plane approximately perpendicular to the horizontal axis associated with base plate 30. The base plate 30 in addition to the base plate upper surface 31 also comprises a lower surface 39. Four ¾" thick triangular metal plates are also secured at the corners of the base plate to result in the base 15 weighing approximately 170 pounds. A rubber pad 40 is preferably placed and secured in coterminous relationship with the lower surface 39.

Screws 41 are used to secure center post 17 to the post support 32 of the base 15. The screws 41 pass through post support apertures 44, which apertures are preferably formed in opposite sides of post support 32, as well as through post support channel 43 and 45. The screws 41 are held in place by nuts of some kind, such as by wing nuts.

Center post 17 is formed having a sidewall 50, a post top 52, a post bottom 54, ad a plurality of post apertures 56. Spanning the opening at the post top 52 is a vertical handle 170. In the preferred embodiment of the invention the center post is formed having four sidewalls, with the post apertures being formed in only one of such sidewalls, as can best be seen in comparing FIGS. 2, 3 and 4. As can be seen in the drawings, preferably the outer dimension of the center post is slightly less than the inner dimension of the post support 32.

Figure 4:
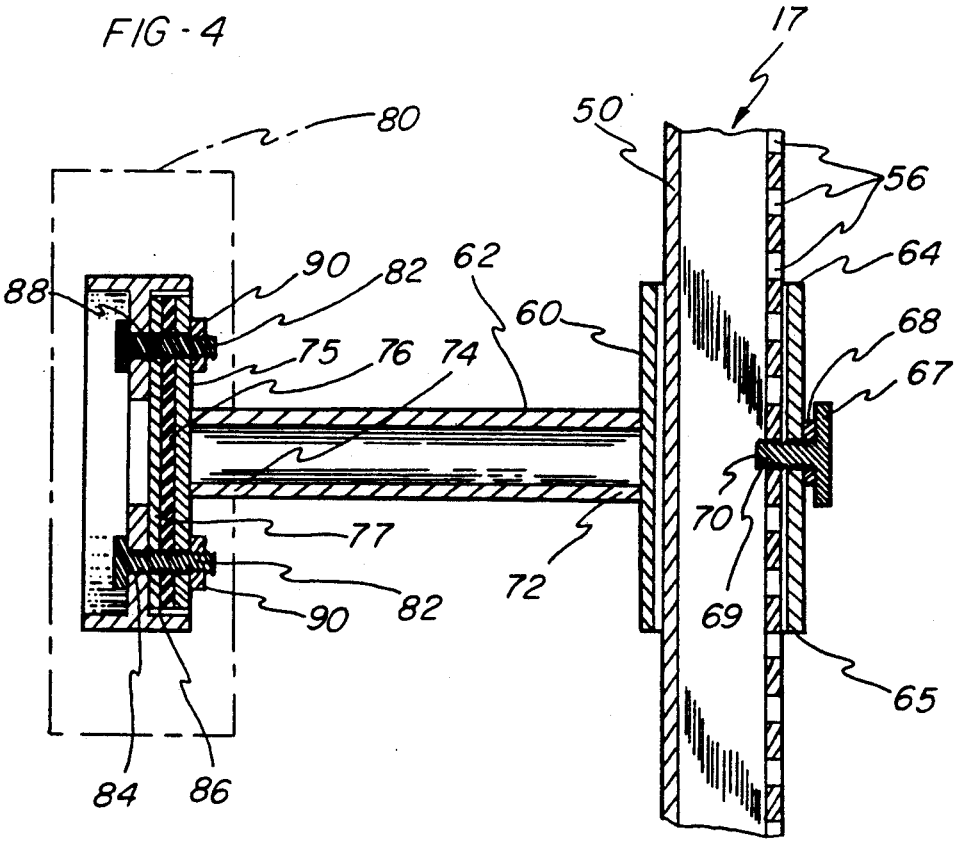
FIG. 4 is a vertical section view of the upper sleeve member taken along line 4—4 of FIG. 1.
Figure 5:
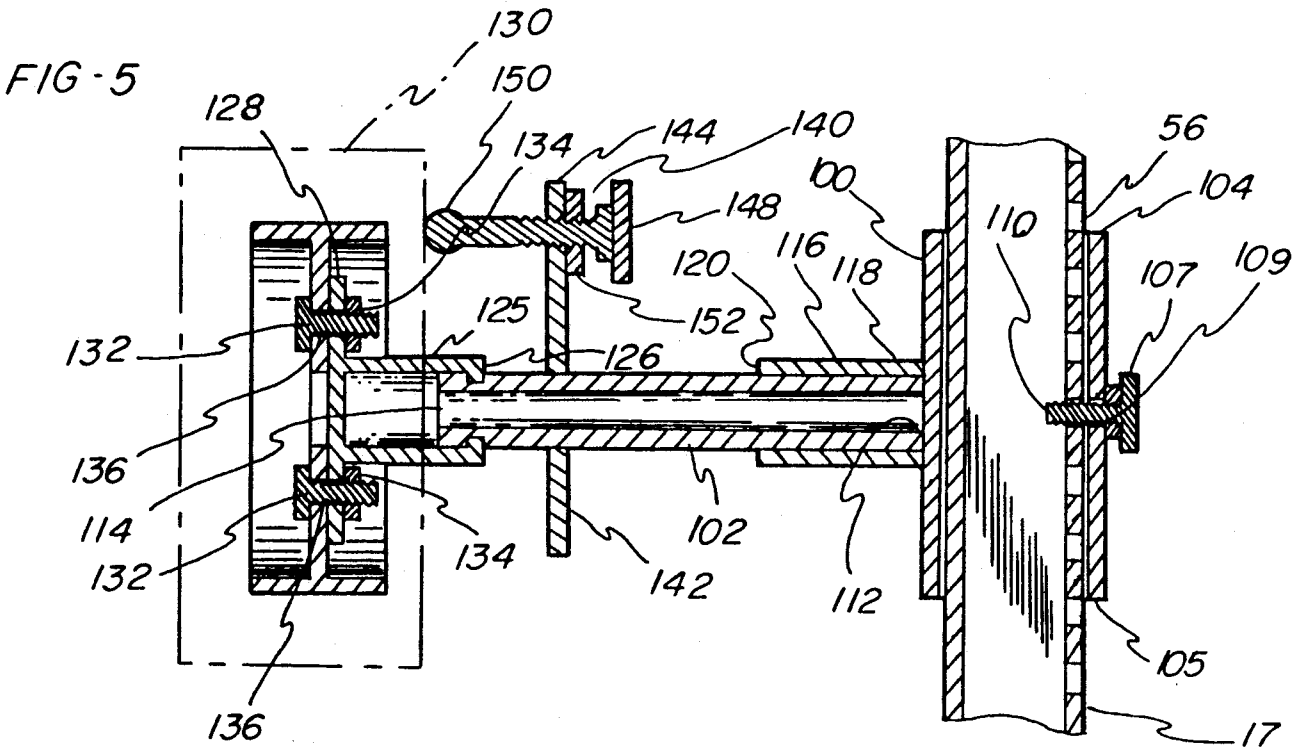
FIG. 5 is a vertical sectional view of the lower sleeve member taken along line 5—5 of FIG. 1.

Turning now to FIGS. 2, 3, and 4, it can be appreciated that the upper sleeve member 19 is formed having a vertical component 60 as well as a horizontal component 62. The vertical component of the upper sleeve member is dimensioned such that its inner dimension is slightly greater than the outer dimension of the post 17. Vertical component 60 has a top 64, as well as a bottom 65 and is secured relative to the center post by means of a bolt 67. The bolt 67 has a first portion 68, approximately 1½" high, which is relatively vertical and which serves as a handle, and a second portion 69 which is relatively horizontal. The second portion 69 includes a segment adjacent the first portion which is threaded and a segment at the terminal end 70 of the second portion which is of a smaller diameter than the remainder of the second portion. The bolt end 70 is inserted through an appropriate post aperture 56 to position the upper sleeve member 19 relative to the base.

The horizontal component 62 which is preferably formed of a 2" round metal tube, has a first end 72 which is preferably welded tot he sidewalls of the vertical component 60. The horizontal component 62 is also preferably 7" long. Additionally, the horizontal component has a second end, which with respect to the upper sleeve member 19 is preferably welded to a first plate 75, which in the preferred embodiment is of a circular shape. This first plate 75 has secured to its opposite face a rubber layer 76. A second plate 77, also preferably circular, is positioned adjacent the rubber layer with this second plate 77 preferably having been previously secured through welding or other appropriate means to the upper barrier 80. The upper barrier 80 is preferably formed of a tire, such that the second plate is secured to the metal wheel hub. The tire is preferably 14" in diameter, with a tread width of 8".

The upper barrier 80 and its second plate 77 are secured to the upper sleeve member 19 and the horizontal component 62 by fasteners 82. These fasteners extend through upper barrier apertures 84 as well as through second plate apertures 86. With respect to the upper sleeve member, a pair of overlapping slots 88 are formed in both the first plate 75 and rubber layer 76. Fasteners 82 pass through the slots and are held in place by nut 90.

The lower sleeve member 21 is also formed having a vertical component 100 and a horizontal component 102. The vertical component 100 has a top 104, a bottom 105, and a bolt 107 with the bolt having a first portion 108, a second portion 109, and a bolt end 110 identical to the components of bolt 67. In the same way as bolt 67 engages the upper sleeve member and post, bolt 107 provides for the attachment of the lower sleeve member 21 to the center post 17. The threaded bolts 67 and 107 can pass through threaded apertures int he vertical components 60 and 100 respectively. More preferably a threaded nut is welded adjacent the apertures in the vertical components, and the threaded volt is screwed therethrough.

The horizontal component 102 of the lower sleeve member 21 has a first end 112 which is preferably welded to the vertical component 100 and a second end 114 which connects to axle 125 associated with lower barrier 130. Additionally, the lower sleeve member 21 may have a second horizontal component 116 with a first end 118 and a second end 120. The second end 120 terminates at a point between the vertical component 100 and the axle 125. The horizontal component 102 and the second horizontal component 116 are preferably welded to one another.

The purpose of the second horizontal component is to provide further strengthening for the horizontal component 102. Thus, it can be appreciated that the inner diameter of the second horizontal component 116 must be at least slightly grater than the outer diameter of horizontal component 102. Axle 125 has a first end 126 which encircles horizontal component 102, and which permits the lower barrier to rotate. Additionally, axle 125 has an axle plate 128 similar in size to second plate 77, which is secured to lower barrier 130 by fastener 132 and nut 134 with the fastener also passing through lower barrier apertures 136. While the upper and lower barriers are preferably formed of small tires, the remainder of the device is preferably formed form a durable metal, such as steel. The presence of the axle 125 permits the lower barrier 130 to rotate relative to the horizontal component 102 of the lower sleeve member. Additionally attached to the horizontal component of the lower sleeve is a tension adjustment means 140 which controls the ease with which the lower barrier rotates. The tension adjustment means 140 comprises a plate 142 secured, preferably by welding, to the horizontal component 102. The plate 142 has an aperture 144 through which a threaded bolt 146 passes.

At the end of the bolt nearest the post 17 is a handle, preferably 1½ in diameter, just like the handles on the bolts 67 and 107. At the other end of bolt 146 is a tension impact head 150, preferably a spherical ball welded to the end of bolt 146. Screwing of the bolt 146 through aperture 144, or more preferably through threaded nut 152, which is welded to plate 142, causes impact head 150 to rub against the lower barrier with increase or decreased levels of friction, which in turn will control the ease of rotation of the lower barrier.

In the preferred embodiment of the invention the base plate 30 is ⅜" thick; the various rib supports 34 are ¼" thick; the post support and post 17 are 3/16" thick; with the center post 17 in addition to be being 3/16" thick also being preferably 5'. Each of the two slots are ½" wide and have an arc formed with a 2' radius. Each of the rib supports 34 is shown as being of a trapezoidal configuration with the edge adjacent the post support being 4" high, the opposite edge being 1" high, and the base being preferably at lease 11" long.

The base plate is approximately 3' long and 2' wide, with the various rib supports which could number between four and eight, terminating approximately 2" from the edges and ends of the base plate. The post support is approximately 4" square. The post apertures ar preferably ½" in diameter and spaced approximately 1" apart. There are a plurality of hoes int he post, and in the preferred embodiment of the invention the lower most hole is formed 1'3" from the bottom of the post, and the top-most aperture is formed 5" from the top of the post. The post support channel 44 is formed having ½" holes positioned 2" apart beginning at a location 8" above the bottom of the center post 17.

The horizontal component 62 is preferably a 2" round tube which is 10" long and 3/16" thick. The first plate 75 is approximately 10" in diameter, and 3/16" thick. The slots span ar arc of 40°, which permits the adjustment of the upper barrier relative to the lower barrier to permit the modification from a level swig of plus or minus 22°. Finally, the rotating aspect of the lower barrier permits the device to better absorb the shock of a bad swing so as not to cause wrist or hand sprain.

In actual operation, the preferred embodiment of the invention can be set-up either indoors or out of doors. In the configuration shown in FIG. 1, orientation of the castors so as to be approximately parallel to the base plate, permits the base plate to be tipped so as to transport the device. To assist in the correct positioning of the training device as well as in moving of the entire device, the handles along the base may be utilized. Additionally, a handle 170 is welded across the top of the center post. Of course, it does not interfere with lifting either the upper or lower sleeve off the center post for purposes of disassembly.

Once the device is positioned for use, a batter is positioned a predetermined distance from the baseball training device such that the batter is facing and standing directly adjacent to the upper and lower barriers. This predetermined distance is one which permits the bat when swung to pass between t he barriers but not hit the post. The upper barrier is initially spaced a first distance form the lower barrier with both the upper barrier and lower barrier also being spaced a distance from the post, to further assist in preventing the bat from coming into accidental contact with the post during a swing. The batter then swings a bat toward the device such that the path of the bat is directed between the upper barrier and the lower barrier. Since the first distance is preferably greater than the width of the bat, the bat should pass between the two barriers without engaging in physical contact. If physical contact occurs, it may well be because the swing is not level. However, it may be the result of the height of the opening between the barrier being in a horizontal plane significantly above or below the desired horizontal swing plane of the batter. If that is the case, one or both of the upper and lower sleeve members can be adjusted either upwardly or downwardly along the center post through the use of the respective bolts until the space between the upper and lower barriers is positioned at the proper height.

Another reason for coming into contact with either the upper or lower barrier during a swing is that although the space is the correct height above the ground or floor, the swing is simply not level. Repeated practice should enable the batter to relatively effortlessly swing the bat between the upper and lower barriers. The space between the upper and lower barriers can then be adjusted, such that it is less than the first distance, thereby decreasing the tolerance associated with the levelness of the swing. If contact is occurring between the bat and the baseball training device, continued follow-through of the swing should enable the bat to ultimately pass between the upper and lower barrier. The distance between the barriers can be repeatedly decreased as the levelness of the swing improves.

Preferably at some point in time, a subsequent adjustment to the distance between the upper barrier and the lower barrier will result in the bat encountering greater difficulty in easily passing between the upper and lower barriers. Consequently, the greater the velocity of the swung bat and therefore the greater the force associated with the swing of the bat, the easier it will be for the bat to pass between the upper and lower barrier. This process develops a more powerful swing as it increasingly becomes necessary to swing with power in order to facilitate passage of the bat between the two barriers.

In addition to providing a method for developing a more level and more powerful swing, the baseball training device of this invention also permits the user to work on developing more effectiveness in hitting ground balls, as well as in hitting fly balls. This can best be seen by reference to FIG. 3, where two alternative positions of the upper barrier are shown in dotted lines.

Utilizing the upper device with upper barrier 80 as discussed above results in developing a level swing. However, in hitting ground balls, it is desirable to hit the ball on the top side. therefore, positioning the upper barrier as shown in 80" allows the batter to swing level until such time as contact with the ball is desired at which time the ball is struck on the topside. The position of the upper barrier 80" necessitates that the batter ultimately swing downwardly, preferably at the point of contact with the ball. In using the device of this invention, such a swing can thus be cultivated. Similarly, in attempting to hit a fly ball the ball is hit on the underside. Therefore, with the upper barrier positioned as is shown in 80' the swing is made to approach the point of contact with the ball from the underside. In addition to positioning the upper barrier throughout the 40° range associated with the arc of slots 88, the space between the upper and lower barriers can be decreased, such that more powerful ground ball swings and more powerful fly bal swings can be developed.

While the form of apparatus and method herein described constitutes a preferred embodiment of the invention, it is to be understood that the invention is not limited to this precise form of apparatus or method and that changes may be made therein without departing form the scope of the invention which is defined in the appended claims.

What is claimed is:

1. A baseball training device comprising a base, a post, said post being supported by and extending upwardly from said base, a first member secured to said post, said first member comprising a sleeve for attaching said first member to said post, a first barrier, a slotted plate, and a first horizontal component connected to said first member, said first barrier being spaced a distance form said post, said first horizontal component being disposed between said post and said first barrier, and said slotted plate secured to both said first barrier and said first horizontal component, and a second member secured to said post, said second member comprising a sleeve for attaching said second member to said post, a second barrier and a second horizontal component connected to said second member, said second barrier being circular and spaced a distance from said post, said second horizontal component being disposed between said post and said second barrier.

2. The device according to claim 1 wherein said second barrier is rotatably mounted on said second horizontal component.

3. The device according to claim 1 wherein said base has secured thereto a plurality of castors.

4. The device according to claim 1 wherein said base comprises a base plate, a post support secured to said base plate, and a plurality of rib supports secured to both said base plate and said post support.

5. The device according to claim 4 wherein said post support is secured to said post.

6. The device according to claim 1 wherein both said first member and said second member include spring bolt, and said post having a plurality of apertures therein for engagement by said spring bolt.

7. The device according to claim 1 wherein said first barrier has a vertical axis and said lower barrier has a vertical axis, said axes being coincident.

8. The device according to claim 1 wherein said first barrier has a vertical axis and said second barrier has a vertical axis, said axes being parallel to each other.

* * * * *